United States Patent [19]

Carra et al.

[11] 3,937,859

[45] Feb. 10, 1976

[54] INTERLINING MADE OF A THERMOPLASTIC AND THERMOSETTING RESIN COMPOSITION

[75] Inventors: Mark Ernest Carra, Springfield; Louis Albert Manrique, Jr., Chicopee, both of Mass.

[73] Assignee: Johnson & Johnson, New Brunswick, N.J.

[22] Filed: Apr. 12, 1974

[21] Appl. No.: 460,659

[52] U.S. Cl. ..... 428/194; 156/331; 427/195; 427/197; 427/207; 427/256; 427/284; 428/198; 428/261; 428/347; 428/355

[51] Int. Cl.[2] ..... B32B 3/02; B32B 7/14

[58] Field of Search ..... C09J/7/02; 117/161 UT, 117/21; 16, 25, 122 H; 260/853, 856; 427/195, 197, 284, 207, 256; 428/194, 198, 261, 347, 355; 156/331

[56] References Cited

UNITED STATES PATENTS

| | | | |
|---|---|---|---|
| 3,062,686 | 11/1962 | Graulich et al. | 117/38 X |
| 3,317,631 | 5/1972 | Rees | 260/853 |
| 3,357,849 | 12/1967 | Meulenbeld | 117/44 X |
| 3,535,183 | 10/1970 | Marriott et al. | 260/856 X |
| 3,684,564 | 8/1972 | Lefrancois | 117/122 H |
| 3,700,492 | 10/1972 | Bergomi | 117/161 UT X |
| 3,714,104 | 1/1973 | Bergomi | 117/161 UT |
| 3,714,298 | 1/1973 | Bergomi | 117/161 UT |
| 3,834,979 | 9/1974 | Rossell et al. | 117/44 X |

*Primary Examiner*—William D. Martin
*Assistant Examiner*—Shrive P. Beck

[57] ABSTRACT

A new and improved resin composition having both thermoplastic and thermosetting properties and suitable for use for coating fabrics to produce fusible interlinings. The resin composition consists of a terpolymer having the following formula:

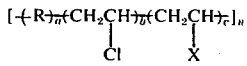

where R is selected from the group consisting of ethylene, propylene and butylene, *a* and *b* are substantially equal, *a* plus *b* equals 20*c*, X is a radical selected from the group consisting of $CONH_2$ and COOH and *n* is an integer from 100 to 300. The composition also contains an aminoplast.

8 Claims, No Drawings

INTERLINING MADE OF A THERMOPLASTIC AND THERMOSETTING RESIN COMPOSITION

BACKGROUND OF THE INVENTION

The present invention relates to a new and improved fusible interlining. Fusible interlinings have been used in the manufacture of apparel for a number of years. Broadly fusible interlinings are woven, nonwoven or knit fabrics which have one or both surfaces coated with a thermoplastic resin material so that when the interlining is heated, the thermoplastic resin will melt and adhere the interlining to another fabric such as the outer apparel fabric. The advantages of such fusible interlinings are their ease of handling, simplicity of processing, reproducibility in manufacturing a plurality of garment parts of the same shape and form, and their economic advantage.

A major problem with these fusible interlinings is the poor resistance of the thermoplastic material to dry cleaning fluids and hot water or boiling water washing. A technique for improving the dry cleanability of the fusible interlining is to include a thermosetting resin in the coating along with the thermoplastic material. When the fusible interlining is adhered to the outer apparel, the thermosetting resin is also cross-linked to improve the dry cleanability of the laminate. However, it is difficult to control the cross-linking of the thermosetting resins. The thermosetting resin may cross-link before the thermoplastic material has been heated sufficiently to adhere the interlining to the outer fabric. The interlining is often stored for a period of time before it is used and in these instances, the thermosetting resin may start to cross-link during storage and hinder the further use of the fusible interlining material.

Also, the fusible interlining, if it does contain a thermosetting resin should be fusible to the outer apparel and cross-linkable at relatively low temperatures and pressures to allow wide acceptability and usage on the various types of pressing and fusing machines used in the industry.

SUMMARY OF THE PRESENT INVENTION

We have now discovered a new fusible coating composition which will produce a laminate having good washing characteristics and excellent dry cleaning characteristics. Our new coating composition is a combination of thermoplastic and thermosetting resins and our new coating composition will readily cross-link at relatively low temperatures and pressures and on the various standard fusing presses used in the industry today. Furthermore, our new composition has an excellent shelf life and may be stored for many months without detrimental effects on the performance of the fusible interlining when it is fused to the outer apparel fabric.

Our new thermoplastic/thermosetting composition consists of a copolymer having the following formula:

$$[-(R)_a(CH_2\underset{\underset{Cl}{|}}{C}H)_b(CH_2\underset{\underset{X}{|}}{C}H)_c]_n$$

where R is selected from the group consisting of ethylene, propylene and butylene, a and b are substantially equal, *a* plus *b* equals 20*c*, X is a radical selected from the group consisting of amide radicals and carboxyl radicals and *n* is an integer of from 100 to 300. Our new composition also contains an aminoplast whereby the composition will melt and become adhesive at moderately elevated temperatures and will cross-link without the addition of catalyst. The fusing and cross-linking will occur over a 12 second period at temperatures of from 250°F to 350°F.

DETAILED DESCRIPTION OF THE PRESENT INVENTION

The thermoplastic portion of our new thermoplastic/-thermosetting composition is an olefin, vinyl chloride, copolymer preferably an ethylene, vinyl chloride terpolymer. The polymer contains both ethylene groups and vinyl chloride groups and the numbers of these groups are substantially the same. The terpolymer also contains amide and/or carboxyl radicals generally in an amount of about 5% or less, so that the number of amide or carboxyl radicals is 1/twentieth of the total olefin and vinyl chloride groups.

The amide and/or carboxyl radicals provide the cross-linking sites in the polymer to provide the thermosetting nature of our new composition when combined with an aminoplast. Any of the well-known aminoplast cross-linking agents such as ureaformaldehyde resins, triazine formaldehyde resins, melamine resins and the like may be used. It is preferred that the melamine cross-linking agents be used as these are easier and simpler to cross-link with the olefin, vinyl chloride copolymer resin. The thermoplastic/thermoset resin composition of the olefin, vinyl chloride copolymer and aminoplast is applied to any of the well-known base fabrics which may be woven fabrics, knitted fabrics, nonwoven fabrics and the like. The coating may be an overall coating or a patterned coating and either one or both surfaces of the fabric may be coated.

In manufacturing our new fusible interlinings, it is preferred that the starting ethylene, vinyl chloride, copolymer be in powder form. The powdered form is preferred over the latex form as the powder appears to be less chemically reactive and not as cross-linkable under shelf life conditions as is the latex. It is believed that this may be due to the smaller particles and more intimate mixing inherent in a latex as compared to a powder. Also, the powder does not strike through the fabric and gives better printing control if the composition is to be applied in a pattern. Also in the final product, the larger particle size of the powder is less readily attacked by dry cleaning solvents as are the smaller latex particles.

To the olefin, vinyl chloride copolymer powder a high solids level aminoplast, usually in an alcohol-water solution, is mixed with the powder and the material thickened to provide a paste which may be readily applied to the base fabric by standard coating apparatus.

Suitable aminoplasts which may be used in our fusible interlinings are melamine formaldehydes, triazine formaldehydes and ureaformaldehydes, in either liquid or powder form. Generally from about 10 to 60 percent of the composition is the aminoplast.

The olefin, vinyl chloride terpolymer must have a cross-linkable mer present as described above and generally from about 1 to 5% of the copolymer should be of this cross-linkable mer. The copolymer must have a sufficient level of vinyl chloride mer present. It is believed this is essential as the vinyl chloride will give off hydrogen chloride gas upon heating which it is theorized acts as a catalyst in the cross-linking reaction. The critical nature of our new fusible interlining is that there is no catalyst readily available in the thermoplastic/thermosetting coating. This gives the interlining an excellent shelf life as there is no catalyst to initiate or speed up the cross-linking reaction, yet unexpectedly when heated a catalyst for the cross-linking reaction is available through the release of hydrogen chloride gas by the vinyl chloride portion of the copolymer. This allows for rapid cross-linking of the polymer at relatively low temperatures and short time periods. This makes our new fusible interlining suitable for use with present equipment available to the industry without having to make modifications in temperature or pressures and without having to slow down operations and make operations uneconomical.

In manufacturing our new fusible interlining, the paste as described above of the olefin vinyl chloride copolymer and the aminoplast is applied to the base fabric as is well known in the manufacture of fusible interlinings. The fabric with the coating thereon is dried for 20 to 30 seconds at about 220°F. to adhere the coating to the base fabric. These conditions raise the temperature of the resin itself to about 150°F. and there is no significant cross-linking of the resin at this time. The fabric is then applied to the outer apparel fabric or material to which it is to be laminated. The lamination is accomplished at from about 250°F. to about 350°F. for a time period of about 12 seconds and under pressures of about three pounds per square inch which gives good adherence between fabrics and also cross-links the coating composition to provide a laminate which has excellent washability and dry cleanability.

The invention is further illustrated by the following example which should not, however, be construed as fully delineating the scope of this discovery.

EXAMPLE

A thermoplastic-thermosetting coating composition is made by starting with a melamine formaldehyde cross-linking resin sold by the Monsanto Company under the tradename "Uformite." The resin is in a isopropanol-water solvent and contains about 80% solids. About 60 parts of the resin are used. To the melamine formaldehyde resin about 100 parts of an ethylene, vinyl chloride terpolymer in powder form is added. The ethylene, vinyl chloride terpolymer contains about 5% amide groupings and contains about equal portions of ethylene and vinyl chloride monomers. The combination is thickened to form a paste and ammonia or an ethanol amine added to make the system alkaline stable. A woven fabric weighing about 70 grams/yd.$^2$ is coated with this paste by applying the paste to one surface of the fabric using a rotary screen printer. About 30 grams per square yard of the paste are added to the fabric in an 11 by 13 dot pattern. The coated fabric is passed through a drying oven for approximately 25 seconds with the oven at a temperature of about 220°F. to adhere the paste to the fabric and dry the paste.

The fabric with the coating thereon may then be stored at room temperature for periods of time of from 6 months to a year or more without serious strength loss upon bonding. When it is desired to laminate the fusible interlining to the outer apparel fabric, this is accomplished by taking the outer apparel fabric placing it against the coated surface and heating the laminate to about 300°F. for 12 seconds at pressures of about 3 pounds per square inch to produce a well bonded laminate which readily withstands washing and dry cleaning conditions.

Although a specific example of the invention has been set forth herein, it is not intended to limit the invention thereto, but to include all of the variations and modifications falling within the scope of the appended claims.

What is claimed is:

1. A fusible interlining comprising a fabric carrying a coating of a thermoplastic-thermosetting composition consisting of a terpolymer having the following formula:

$$[-(R)_a(CH_2\underset{\underset{Cl}{|}}{CH})_b(CH_2\underset{\underset{X}{|}}{CH})_c-]_n$$

where R is selected from the group consisting of ethylene, propylene and butylene, *a* and *b* are substantially equal, *a* plus *b* equals 20*c*, x is a radical selected from the group consisting of $CONH_2$ and COOH, *n* is an integer of from 100 to 300, and an aminoplast whereby the coating will soften and become adhesive at elevated temperatures of about 150°F. and will cross-link without the addition of any catalyst when heated to a temperature of from 250°F. to 350°F. for no longer than a 12 second period.

2. A fusible interlining according to claim 1 wherein the fabric is a woven fabric.

3. A fusible interlining according to claim 1 wherein the coating is in a discontinuous pattern on one surface of the fabric.

4. A fusible interlining according to claim 1 wherein the aminoplast is a melamine formaldehyde resin.

5. A fusible interlining according to claim 1 wherein the coating contains from about 10 to 60% by weight of an aminoplast.

6. A fusible interlining according to claim 1 wherein X is $CONH_2$.

7. A fusible interlining according to claim 1 wherein R is ethylene.

8. A fusible interlining according to claim 1 wherein the fabric is a woven fabric, the coating is in a discontinuous pattern on one surface of the fabric, R is ethylene, X is $CONH_2$ and the aminoplast is a melamine-formaldehyde resin.

* * * * *